US009045890B2

(12) United States Patent
Kuru et al.

(10) Patent No.: US 9,045,890 B2
(45) Date of Patent: Jun. 2, 2015

(54) PRESSURE TOILET WITH BULK LOADING SIPHON ASSIST

(75) Inventors: William C. Kuru, Plymouth, WI (US); Kyle L. Hokel, Sheboygan Falls, WI (US); Luke Benjamin Zimbric, Saukville, WI (US)

(73) Assignee: Kohler Co., Kohler, WI (US)

( * ) Notice: Subject to any disclaimer, the term of this patent is extended or adjusted under 35 U.S.C. 154(b) by 1789 days.

(21) Appl. No.: 11/074,538

(22) Filed: Mar. 8, 2005

(65) Prior Publication Data

US 2006/0200898 A1 Sep. 14, 2006

(51) Int. Cl.

| | |
|---|---|
| ***E03D 11/02*** | (2006.01) |
| ***E03D 11/18*** | (2006.01) |
| ***E03D 11/08*** | (2006.01) |

(52) U.S. Cl.

CPC ..... *E03D 11/02* (2013.01); *E03D 11/08* (2013.01); *E03D 2201/30* (2013.01)

(58) Field of Classification Search

USPC ..... 4/354, 368, 421, 425

See application file for complete search history.

(56) References Cited

U.S. PATENT DOCUMENTS

| | | | | |
|---|---|---|---|---|
| 1,979,739 | A * | 11/1934 | Groeniger | 4/425 |
| 2,129,398 | A | 9/1938 | Beam | |
| 2,659,897 | A * | 11/1953 | Smith | 4/421 |
| 3,654,641 | A * | 4/1972 | Braun, Sr. | 4/256.1 |
| 5,046,201 | A | 9/1991 | Steinhardt et al. | |
| 5,054,133 | A | 10/1991 | Pickerrell et al. | |
| 5,295,273 | A | 3/1994 | Unger et al. | |
| 5,305,475 | A | 4/1994 | Jaeckels et al. | |
| 5,487,193 | A | 1/1996 | Hennessy | |
| 5,502,845 | A * | 4/1996 | Hayashi et al. | 4/300 |
| 5,579,542 | A | 12/1996 | Hayman | |
| 6,219,855 | B1 | 4/2001 | Hsu | |
| 2004/0139538 | A1 | 7/2004 | Kuru et al. | |
| 2004/0194200 | A1 | 10/2004 | Li | |

FOREIGN PATENT DOCUMENTS

| | | | |
|---|---|---|---|
| JP | 06173319 | A * | 6/1994 |
| JP | 09195366 | | 7/1997 |
| WO | WO 2004/089176 | A2 | 10/2004 |

OTHER PUBLICATIONS

Corresponding Mexican Patent Application No. MX/a/2007/010982 Office Action, date of action unknown.

* cited by examiner

*Primary Examiner* — Tuan N Nguyen
(74) *Attorney, Agent, or Firm* — Foley & Lardner LLP

(57) ABSTRACT

A pressure toilet has a trapway providing "as needed" (bulk dependent) siphon assist. During normal liquid waste or low bulk flushing, no siphon is formed in the trapway, and the water and light waste in the bowl are evacuated solely under the force of the pressurized jet of water. A large volume near or just downstream from the dam is provided to accommodate the blow out from the water jet. Only upon reaching a threshold concentration of bulk waste material in the down leg does the trapway draw a siphon. A horizontal baffle at the lower part of the down leg assists in the accumulation of bulk material of sufficient concentration to establish a siphon in the trapway.

20 Claims, 3 Drawing Sheets

PRESSURE TOILET WITH BULK LOADING SIPHON ASSIST

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to toilets, and particular to pressure toilets with siphon assist.

Achieving an effective flush of a toilet when the bowl is filled with feces, toilet paper, and other solids can be difficult, particularly with a low water consumption toilet. It is common, again especially with some low water consumption toilets, for consumers to flush the toilet twice or more to clean the bowl to their satisfaction. This is not only frustrating and time consuming for consumers, it subverts the environmental and water conservation efforts in many jurisdictions that regulate water consumption, which in many areas may be no more than 1.6 gallons (6.1 liters) of water per flush.

Conventional toilets have a bowl and a storage tank, usually formed in one or two main pieces. A serpentine passage, typically referred to as a "trapway", is positioned behind and below the bowl as conduit for the contents of the bowl to the waste plumbing lines of the building. While the precise configuration of a toilet's trapway varies, all generally include an up leg, which is normally filled with water to "trap" sewer gases downstream thereof, so as to prevent them entering the building interior. Water is maintained in the bowl and the up leg of the trapway by an arched weir or dam of the trapway that is elevated above the opening of the bowl. The trapway thus also helps retain water in the bowl prior to flushing.

During a flush cycle, water and waste within the bowl are passed up the up leg over the dam, down a down leg and through an outlet to plumbing lines. The mechanism for creating a flush is different when comparing pressure flush toilets and gravity flush toilets. The latter makes use of the air in the down leg and the pressure head in the up leg forced over the dam to establish a siphon in the trapway that draws the water and waste from the bowl and out of the trapway. As the bowl is emptied, air enters the trapway and breaks the siphon, and fresh water from the tank refills the bowl.

In pressurized toilets, which use one or a combination of line pressure, tank stored pressurized water, or sump pumped water, a pressurized stream of water is injected into the trapway or the bowl to blow the bowl contents through the trapway. A siphon of the type produced in conventional gravity toilets is typically not used in pressurized toilets. However, some pressurized toilets, (e.g. U.S. Pat. No. 6,219,855) do purport to use a siphon as well.

It is difficult to achieve consistent sustained siphon in the trapway of conventional pressure toilets. This is because the trapways of conventional pressure toilets are typically designed differently than in gravity toilets. In particular, the trapways in pressure toilets usually have a large area down stream from the up leg. This enlarged area accommodates the liquid and bulk waste material that is evacuated rapidly from the bowl and into the trapway by the water jet. Without it, water and waste may be forced back through the up leg and back into the bowl, which may defeat an effective flush.

Unfortunately, the large space downstream from the up leg thus makes achieving and sustaining a siphon difficult. One reason for this is that the large sectional area in the blow out region of the trapway requires more liquid and waste to fill it. Another reason is that air in the down leg prior to initiation of the flush cycle may be forced back into the up leg through a part of this enlarged region not occupied by the evacuating water and waste.

Hence, improvements are desired in pressurized toilets with respect to the use of siphons.

SUMMARY OF THE INVENTION

The invention provides a pressure toilet that provides "as needed" siphon assist, that is during increased bulk loading of the toilet. During normal liquid waste or low bulk flushing, no siphon is generated in the trapway, and the water and light waste in the bowl is adequately evacuated under the force of the pressurized jet of water. An extra volume near or just downstream from the dam is provided to accommodate the blow out from the water jet. Only upon reaching a threshold concentration of bulk waste material in the down leg does the trapway draw a siphon (e.g. when feces and toilet paper are present in the trapway). A horizontal baffle at the lower part of the down leg can assist in the accumulation of bulk waste material of sufficient concentration to establish the siphon in the trapway.

In one aspect the invention provides a toilet having a bowl and pressurized water supply for injecting pressurized water into the trapway (either directly or passing first through the bowl) that extends between a bowl opening and an outlet opening. The trapway effects a siphon only above a threshold concentration of bulk waste material in the trapway, such that no siphon is generated below the threshold level.

The trapway has an up leg extending upward and rearward from the bowl opening to a curved water dam region above the bowl opening to a down leg, which slopes downward and forward to communicate with the outlet. An enlarged volume blow-out section of greater sectional area is provided in the trapway just downstream from the up leg or dam so as accommodate the rapid evacuation "blow out" of waste by the pressure jet without causing blow back through the up leg and back into the bowl.

The threshold bulk waste concentration is preferably between 2 and 5 percent by weight of all material within the trapway apart from the trapway itself. Preferably, the concentration level is taken within the down leg of the trapway. A bulk waste concentration less than this corresponds to light waste loading, including liquid only waste, and by in large no siphon is needed to assist the pressure jet, and a bulk waste concentration at or over this corresponds to significant loading when a siphon can contribute significantly to achieving a sufficient flush.

The trapway can also have an essentially horizontal baffle extending forward from a rear wall of the down leg adjacent to a lower portion of the down leg. This baffle works to accumulate bulk in the down leg of the trapway so that when significant bulk is to be passed through the trapway the bulk waste concentration threshold can be reached and a siphon can be effected sooner in the flush cycle. The siphon and its early initiation help ensure that the wasted will be evacuated in a single flush, even in low water consumption toilets.

In preferred forms, the up leg and down leg are separated by a radius between 0.5 and 1 inches (1.3 cm and 2.5 cm) at the dam. The up leg can extend at an angle between 30 and 45 degrees, and the down leg can extend at an angle between 40 and 60, both with respect to a horizontal plane such as would include the bottom of the toilet or the outlet opening. The dam preferably extends at a height above the bottom of the bowl that is between 4 and 6 inches (10.2 cm and 15.2 cm). The horizontal baffle preferably has a ledge length of between 0.5 inches and 2.5 inches (1.3 cm and 6.4 cm) measured from the rear wall of the down leg and a ledge height of between 1 inch and 3.5 inches (2.5 cm and 8.9 cm) measured from the bottom of the down leg.

The toilet of the present invention exhibits improved bulk flushing characteristics, which can be achieved with low water consumption per flush, preferably 1.4 gallons (5.3 liters), and at a lower flush velocity than is common in pressurized systems, preferably between 8 and 10 meters per second, thereby decreasing flush noise. A suitable minimum ball passage, preferably about 2 inches (5.1 cm) or more, is nevertheless maintained.

The advantages of the invention will be apparent from the detailed description and drawings. What follows is merely a description of a preferred embodiment of the present invention. To assess the full scope of the invention the claims should be looked to as the preferred embodiment is not intended to be the only embodiment within the scope of the claims.

DETAILED DESCRIPTION OF THE PREFERRED EMBODIMENT

Figure 1:
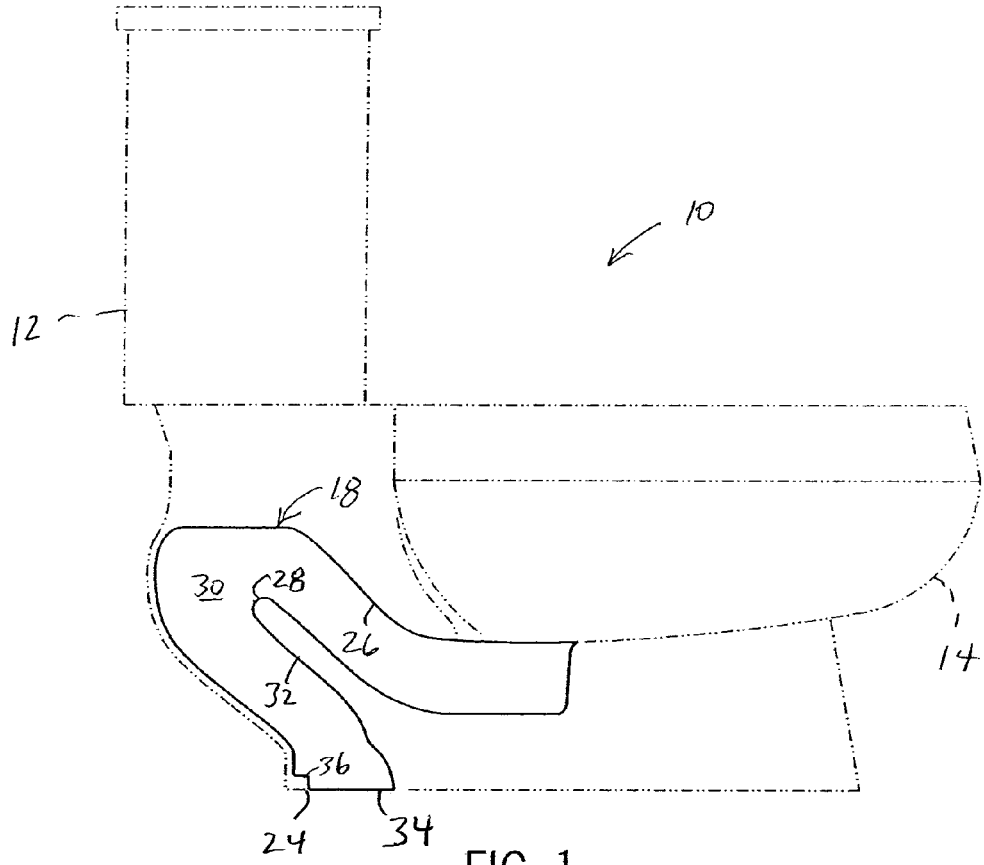
FIG. 1 is a side elevational view of a toilet trapway according to the present invention, with a toilet that the trapway can used in shown in phantom.

FIG. 1 illustrates a pressure toilet 10 having a tank 12, a bowl 14, a jet channel 16 (see FIG. 2) and a trapway 18 according to the present invention. Except for the trapway, the toilet can be any suitable pressure toilet, such as the two piece low volume flush design shown in FIG. 1, providing a pressurized water stream in any known manner, including for example using direct water line pressure, accumulating a volume of pressurized water in the tank, or proving a sump pump for pressurizing the tank water.

U.S. Pat. Nos. 5,305,475 and 5,046,201 disclose examples of pressure assist toilets having mechanisms for generating the water jet suitable for use here. The disclosure of the features for generating and conveying the pressurized water in these patents is hereby incorporated by reference as though fully set forth herein.

In any such manner, water pressurized to greater than atmospheric pressure is passed from the tank 12 through the jet channel 16. Typically, the jet channel 16 is a passage formed in the vitreous base of the toilet and wraps around the front of the bowl 14 so that its outlet is directed toward the rear of the toilet. The jet channel 16 can terminate in a bowl sump 20, the trapway 18 (in an up leg thereof) or at the junction of the trapway 18 and a bowl opening 22, provided it directs the water jet to force the waste within the bowl into the trapway 18. In the toilet 10 shown in FIG. 1, the jet channel 16 terminates at the bowl sump 20 with the water jet passing through opening 23.

Figure 2:
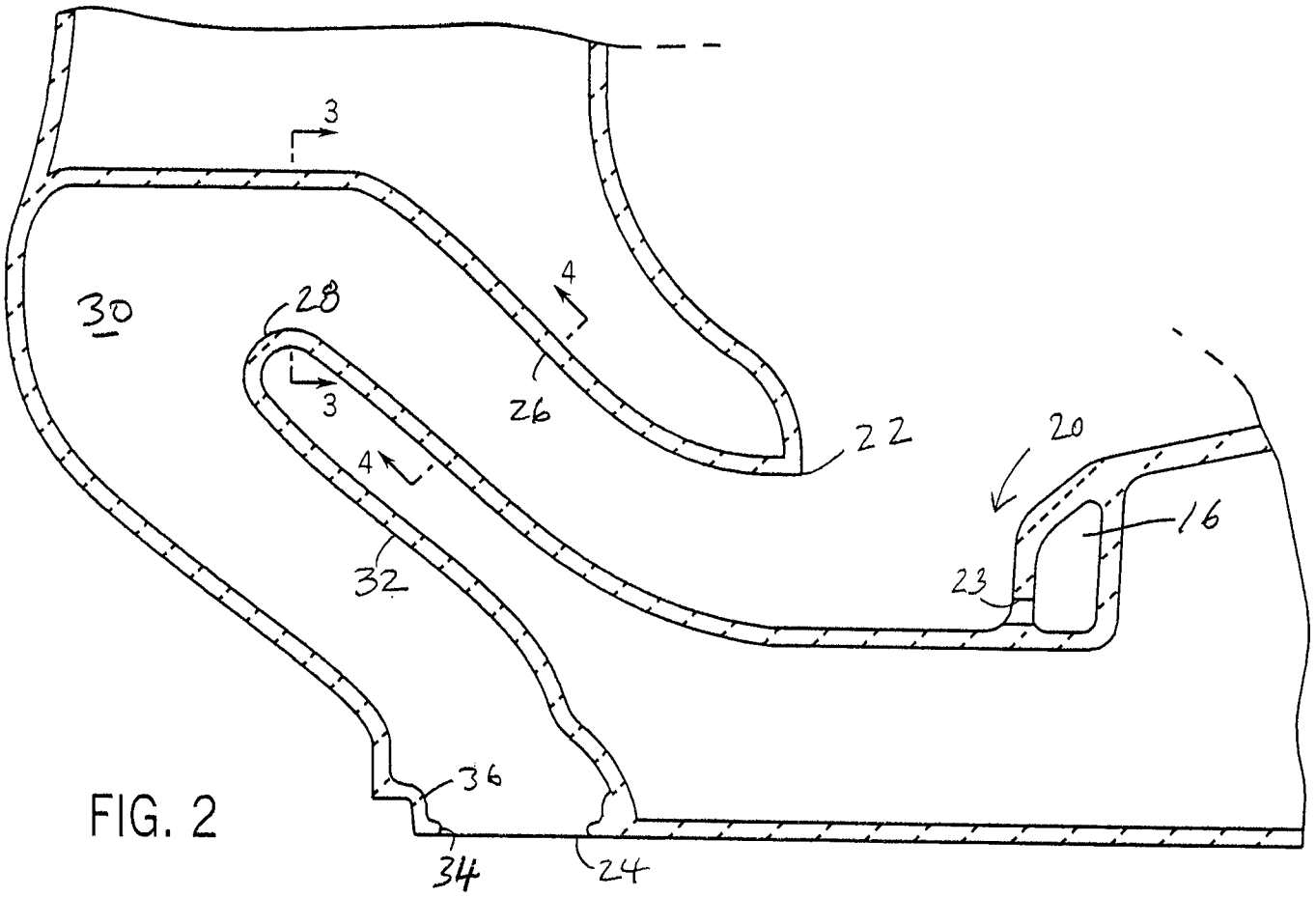
FIG. 2 is a partial vertical cross-sectional view taken down the front-to-back center line of the rear portion of the toilet of FIG. 1.
Figure 3:
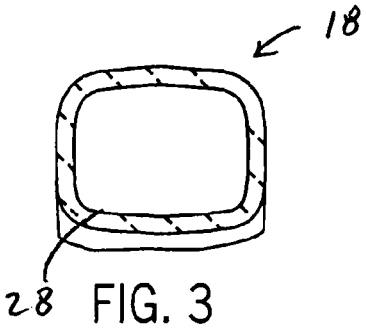
FIG. 3 is a partial cross-sectional view taken along line 3-3 of FIG. 2.
Figure 4:
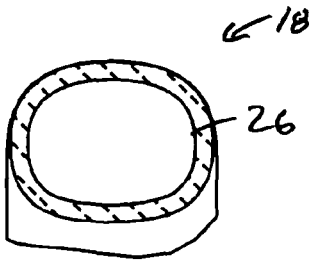
FIG. 4 is a partial cross-sectional view taken along line 4-4 of FIG. 2.

As shown in FIGS. 1 and 2, the trapway 18 extends from the bowl opening 22 along a serpentine path in a generally hairpin configuration with an oblong rounded or somewhat cross-section (as shown in FIGS. 3 and 4). The base of the toilet 10 has an outlet 24, preferably contained within an essentially horizontal plane, at the bottom which the trapway 18 that mounts over the open end of a waste plumbing line (not shown). The trapway 18 thus creates a path for contents in the bowl 14 to flow to the waste line during a flush cycle.

Referring to FIG. 2, an up leg 26 of the trapway 18 extends back from the bowl opening 22 upward and rearward to a bend, the inside diameter of which forms a weir or water dam 28, after which point water can pass through the downstream portion of the trapway 18. At, or immediate downstream from the dam 28 is an enlarged volume "blow out" region 30 which has a larger sectional area to accommodate the waste and water forced rapidly through the up leg 26 by the water jet. Its large size reduces the likelihood of waste blow back into the bowl. A down leg 32 extends from the dam 28 downward and forward down to an opening 34 which aligns with the toilet outlet 24. The dam 28 follows a tight radius such so as to change the flow direction through the down leg 32 about 180 degrees from the direction of flow through the up leg 26.

Adjacent the opening 34 at the bottom end of down leg 32, the trapway 18 has a short, flat horizontal baffle 36 extending between the rear wall of the down leg 32. The baffle 36 works to disrupt flow through the down leg 32. For liquid and very low bulk waste, the baffle 36 improves flow by generating turbulence low in the down leg 32. For larger bulk waste, the baffle 36 works to accumulate bulk in the down leg 32 to achieve the necessary concentration of bulk material necessary to start a siphon, and to do so earlier in the flush cycle.

The trapway 18 is configured and sized specifically to consistently achieve a siphon pull within the trapway 18 to assist the water jet when evacuating large amounts of bulk waste from the bowl 14 during a flush cycle. The trapway 18 is further designed to achieve the siphon only when a threshold concentration of bulk material is present within the trapway, that is when sufficient solid waste is present in the trapway 18. No siphon is established when liquid only or insufficient bulk (below the concentration threshold) is present in the trapway. The bulk waste concentration within the down leg 32 is believed to be of particular significance, and it is in this region that the bulk waste concentration threshold is considered.

Figure 5:
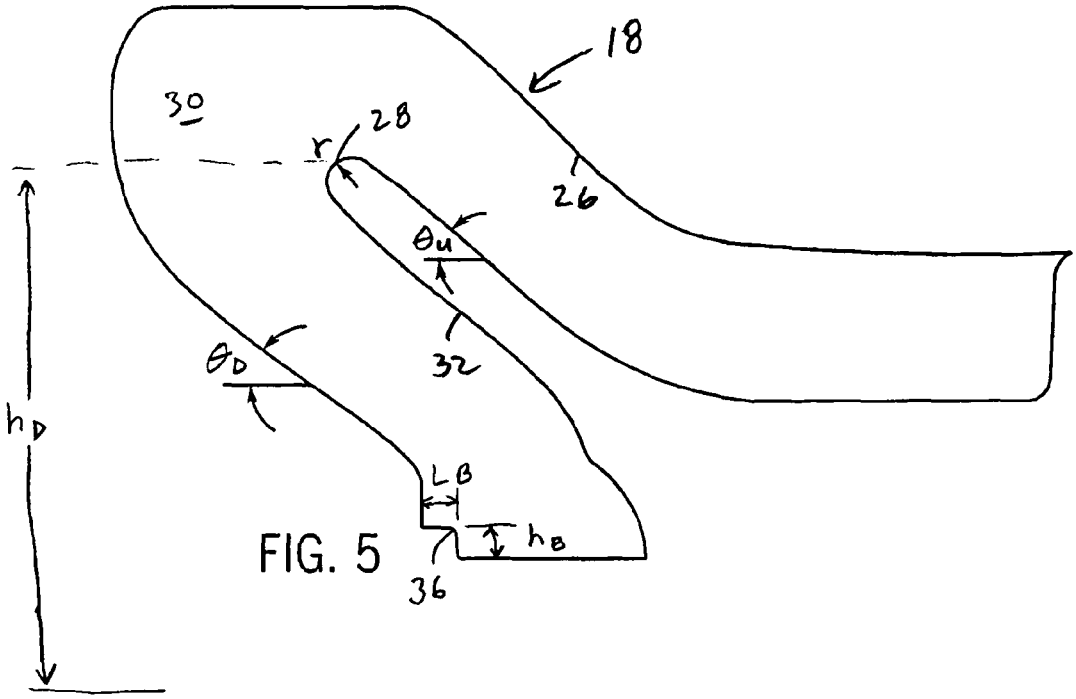
FIG. 5 is a view showing the trapway diagrammatically.

With reference to FIG. 5, the following Table 1 summarizes the values determined to be acceptable and preferred for the various design parameters of the trapway.

TABLE 1

Trapway design parameters

| Parameter | Preferred | Range |
|---|---|---|
| Trapway dam radius (r) | 0.8 in/2 cm | 0.5-1.0 in/1.3-2.5 cm |
| Trapway dam height above bowl ($h_D$) | 4.85 in/12.3 cm | 4.0-6.0 in/10.2-15.2 cm |
| Trapway up leg angle ($\theta_U$) | 32.5 degrees | 30-45 degrees |
| Trapway down leg angle ($\theta_D$) | 50 degrees | 40-60 degrees |
| Baffle ledge length ($L_B$) | 1.1 in/2.8 cm | 0.5-2.5 in/1.3-6.4 cm |
| Baffle ledge height ($h_B$) | 1.2 in/3.0 cm | 1-3.5 in/2.5-8.9 cm |
| Minimum ball passage | 2.0 in/5.1 cm | 1.5-2.5 in/3.8-6.4 cm |
| Bulk waste concentration threshold | 2.5% by weight | 2%-5% by weight |

The values given for the above parameters are dependent on the volume of water in the bowl as well as the volume and rate of water injected through the jet channel during the flush cycle. These values are given in the following Table 2.

TABLE 2

| Toilet conditions | |
|---|---|
| Parameter | Value |
| Bowl volume | 0.75 gallons/2.8 liters |
| Flush volume | 1.4 gallons/5.3 liters |
| Jet velocity | 8.5 m/s |

The inventors have determined empirically that the dam 28 radius (r) and the angle ($\theta_U$) of the up leg 26 from horizontal parameters are most sensitive with respect to bulk waste and the ability to achieve a siphon. The angle (OD) of the down leg 32 has a moderate effect, as does the location and configuration of the baffle 34 ($L_B$) and ($h_B$). The inventors have also determined that a trapway having such configuration can develop a siphon when the bulk waste concentration within the down leg 32 is between 2% and 5% by weight (including liquid mass), with the preferred bulk waste concentration threshold being 2.5% by weight.

The dam radius (r) between the up leg 26 and the down leg 32 is designed preferably to be between 0.5 and 1.0 inches (1.3-2.5 cm). The up leg 26 is designed to extend up and back away from the bowl opening 22 between at an angle $\theta_U$30 and 45 degrees from horizontal. And, the down leg 32 is preferably 40 to 60 degrees from horizontal. The inventors have determined empirically that for the above stated parameters, a dam radius (r) of 0.8 inches (2 cm), an up leg angle ($\theta_U$) of 32.5 degrees and a down leg angle ($\theta_D$) of 50 degrees are most preferred. These values are also selected to help develop a flow profile that carries the bulk material over and away form the inner bend of the water dam 28 and into the down leg 32.

The baffle 34 preferably extends a length ($L_B$) of between 0.5 and 2.5 inches (1.3-6.4 cm) at a height ($h_B$) of between 1 and 3.5 inches (2.5-8.9 cm). The preferred values for these parameters corresponding to those of the other parameters stated above are 1.1 inches (2.8 cm) and 1.2 inch (3.0 cm), respectively. These values provide for a sufficient interruption of flow through the down leg 32 so as to build up bulk material therein without closing off the passage excessively. The baffle ledge height and length will vary up or down proportionally to the radius of the down leg.

Empirical testing has established that a toilet with a trapway of the present invention has improved overall bulk material performance compared to otherwise similar conventional pressure toilets. Its improved ability to remove bulk material allows the toilet to operate at very a low flush volume, 1.4 gallons (5.3 liters) per flush compared to 1.6 gallons (6.1 liters) per flush in conventional toilets, and at a lower jet velocity, preferably 8-10 meters per second (more preferably 8.5 m/s). Thus, the improved toilet consumes less water, operates quieter and handles bulk waste better than conventional pressure toilets.

The empirical studies conducted to establish the improved bulk handing of the toilet and trapway of the present invention include pulp pad, pulp ball and paste testing, commonly performed by one or more participants in the industry to test the flush performance of a toilet. The present toilet has shown at least a 15%, and in some cases a 33%, improvement in the number of pulp pads (for example made of multiple sections of multi-ply toilet paper) able to be evacuated from the bowl in a single flush when compared to conventional pressure toilets. Tests of paper ball loading, (toilet paper crumpled into a ball) have shown that the present toilet can evacuate on the first flush about 90% of 50 paper balls and 50% of 60 paper balls, with the remainder being removed on the second flush and without any plugging of the trapway. Such results are not known to have been replicated in conventional pressure toilets. It should be noted that a 50 1.5-2 inch (3.8-5.1 cm) paper balls of single-ply toilet paper represents roughly a 4% bulk material concentration.

It should be appreciated that a preferred embodiment of the invention has been described above. However, many modifications and variations to the preferred embodiment will be apparent to those skilled in the art, which will be within the spirit and scope of the invention. Therefore, the invention should not be limited to the described embodiment. To ascertain the full scope of the invention, the following claims should be referenced.

INDUSTRIAL APPLICABILITY

The invention provides a pressure toilet with an improved trapway design allowing the toilet to more effectively flush bulk waste material by establishing siphonic pull in the trapway when sufficient bulk material is present within the trapway.

What is claimed is:

1. A toilet having a bowl and a pressurized water supply with a channel for injecting water under pressure into a trapway, the trapway extending between a bowl opening and an outlet, the trapway having an up leg extending upward and rearward from the bowl opening to a water dam region above the bowl opening and a down leg sloping substantially straight downward and forward the entire length from the water dam region to the outlet at an angle between 40 and 60 degrees with respect to a horizontal plane containing the outlet, wherein the down leg of the trapway includes a baffle located adjacent to the horizontal plane containing the outlet for accumulating bulk waste upstream from the outlet and wherein during a flush cycle the toilet effects a siphon when a threshold concentration of bulk waste material is present within the trapway but does not effect a siphon when that concentration of bulk waste material has not yet been reached in the trapway.

2. The toilet of claim 1, wherein said threshold concentration of bulk waste material must be present in the down leg of the trapway to effect the siphon.

3. The toilet of claim 2, wherein the threshold concentration of bulk waste material is between 2 and 5 percent by weight of all material within the down leg apart from the trapway itself.

4. The toilet of claim 1, wherein the up leg and the down leg are separated by a radius between 0.5 inches (1.3 cm) and 1 inch (2.5 cm) at the dam.

5. The toilet of claim 1, wherein the up leg extends at an angle between 30 and 45 degrees with respect to a horizontal plane containing the outlet.

6. The toilet of claim 1, wherein a velocity of the water passing through the channel can deliver water at 8-10 meters per second.

7. The toilet of claim 1, wherein the dam extends at a height above a bottom of the bowl that is between 4 inches (10.2 cm) and 6 inches (15.2 cm).

8. The toilet of claim 1, wherein the baffle is substantially horizontal extending forward from a rear wall of the down leg.

9. The toilet of claim 8, wherein the baffle has a ledge length of between 0.5 inches (1.3 cm) and 2.5 inches (6.4 cm) measured from the rear wall of the down leg.

10. The toilet of claim 8, wherein the baffle has a ledge height of between I inch (2.5 cm) and 3.5 inches (8.9 cm) measured from a bottom of the down leg.

11. The toilet of claim 1, wherein the trapway defines a blow out region having increased sectional area compared to the up leg.

12. A toilet having a bowl and a pressurized tank with a jet channel for injecting water under pressure into a trapway, the trapway extending between a bowl opening and an outlet, the trapway having an up leg extending upward and rearward from the bowl opening to a curved water dam region above the bowl opening and a down leg sloping substantially straight downward and forward the entire length from the water dam region to the outlet at an angle between 40 and 60 degrees with respect to a horizontal plane containing the outlet, wherein the down leg of the trapway includes a baffle located adjacent to the horizontal plane containing the outlet for accumulating bulk waste upstream from the outlet and wherein during a flush cycle the trapway effects a siphon only when a threshold concentration of between 2 and 5 percent bulk waste material by weight of all material within the down leg apart from the trapway itself is present within the down leg of the trapway, and wherein the trapway does not effect a siphon when the threshold concentration of bulk waste material has not been reached.

13. The toilet of claim 12, wherein the up leg extends at an angle between 30 and 45 degrees with respect to a horizontal plane containing the outlet.

14. The toilet of claim 12, wherein the baffle is essentially horizontal extending forward from a rear wall of the down leg.

15. A toilet, comprising:

a bowl having an opening;

a tank for supplying water pressurized to greater than atmospheric pressure;

a jet channel for carrying pressurized water from the tank; and a trapway extending between the bowl opening and an outlet; the trapway having an up leg extending upward and rearward from the bowl opening to a curved water dam region above the bowl opening and a down leg sloping substantially straight downward and forward the entire length from the water dam region to the outlet at an angle between 40 and 60 degrees with respect to a horizontal plane containing the outlet, wherein the down leg of the trapway includes a baffle located adjacent to the horizontal plane containing the outlet for accumulating bulk waste upstream from the outlet;

wherein a flush cycle of the toilet includes injecting a stream of pressurized water through the jet channel so as to force waste in the bowl through the trapway and wherein the flush cycle includes effecting a siphon in the trapway only after a threshold concentration of bulk waste material is present in the trapway and wherein the trapway does not effect a siphon when the threshold concentration of bulk waste material has not been reached.

16. The toilet of claim 8, wherein the baffle does not extend to a front wall of the down leg and is only provided along the rear wall of the down leg.

17. The toilet of claim 14, wherein the baffle does not extend to a front wall of the down leg and is only provided along the rear wall of the down leg.

18. The toilet of claim 15, wherein the baffle is substantially horizontal extending forward from a rear wall of the down leg.

19. The toilet of claim 18, wherein the baffle does not extend to a front wall of the down leg and is only provided along the rear wall of the down leg.

20. The toilet of claim 19, wherein the baffle has a ledge length of between 0.5 inches (1.3 cm) and 2.5 inches (6.4 cm) measured from the rear wall of the down leg.

* * * * *